United States Patent [19]

Bentsen

[11] Patent Number: 4,635,294

[45] Date of Patent: Jan. 6, 1987

[54] MATERIAL FOR MAKING THREE RECLOSABLE BAG SECTIONS FROM EXTRUDED PLASTIC MATERIAL

[75] Inventor: Per Bentsen, Suffern, N.Y.

[73] Assignee: Minigrip Incorporated, Orangeburg, N.Y.

[21] Appl. No.: 720,420

[22] Filed: Apr. 5, 1985

[51] Int. Cl.[4] ..... B65D 33/24

[52] U.S. Cl. ..... 383/37; 138/162; 264/146; 383/65

[58] Field of Search ..... 383/63, 65, 37; 138/118, 162; 264/146; 156/66; 24/587

[56] References Cited

U.S. PATENT DOCUMENTS

| | | | |
|---|---|---|---|
| Re. 29,331 | 8/1977 | Naito | 138/118 |
| 3,338,284 | 8/1967 | Ausnit | 383/65 |
| 3,500,727 | 3/1970 | Behr et al. | 264/146 |
| 3,503,112 | 3/1970 | Siegel | 264/564 |
| 3,532,571 | 10/1970 | Ausnit | 425/305.1 |
| 3,945,403 | 3/1976 | Noguchi | 138/118 |
| 3,948,705 | 4/1976 | Ausnit | 156/73.4 |
| 4,249,982 | 2/1981 | Ausnit | 156/66 |
| 4,290,467 | 9/1981 | Schmidt | 150/3 |
| 4,341,575 | 7/1982 | Herz | 156/244.22 |
| 4,372,793 | 2/1983 | Herz | 156/66 |

*Primary Examiner*—Stephen P. Garbe

*Attorney, Agent, or Firm*—Hill, Van Santen, Steadman & Simpson

[57] ABSTRACT

Material and method for making three reclosable bag sections from separable fastener equipped web, comprising folding opposite free portions of the web upon themselves and folding an intervening portion of the web upon itself and thereby providing three bag sections in a generally Y orientation. Separably interlockable fastener profiles adjacent to juncture of the three sections being arranged to provide a respective bag top separable profile fastener assembly along each of the bag sections. The bag sections are separable from one another at the juncture. Pull flanges may be provided along the separable fastener assembly of each of the sections.

17 Claims, 8 Drawing Figures

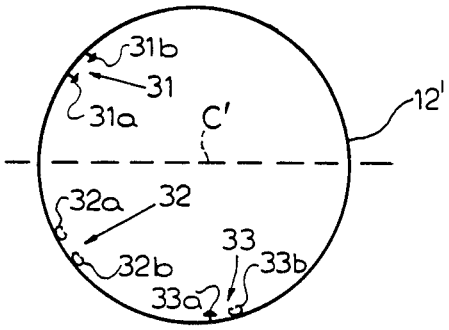
FIG. 4
FIG. 5
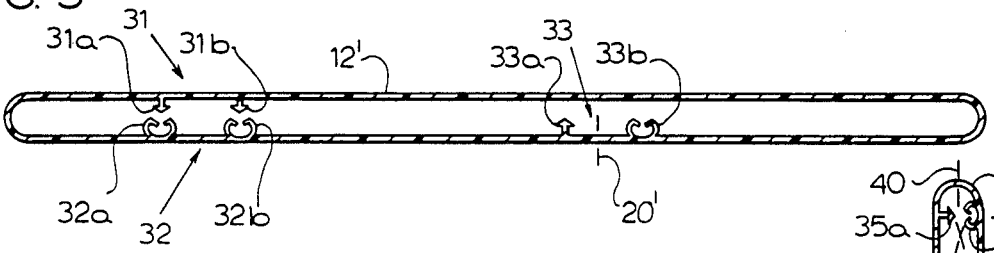
FIG. 6
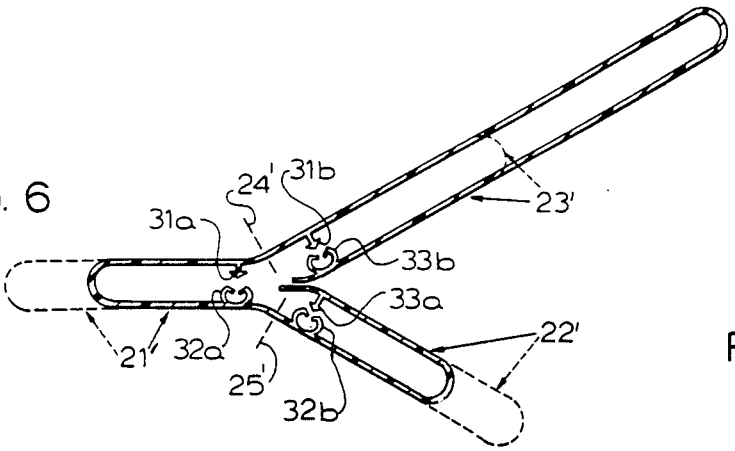
FIG. 7
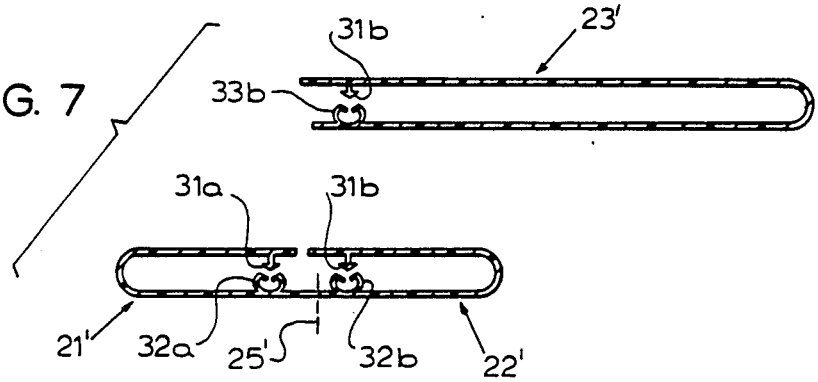
FIG. 8
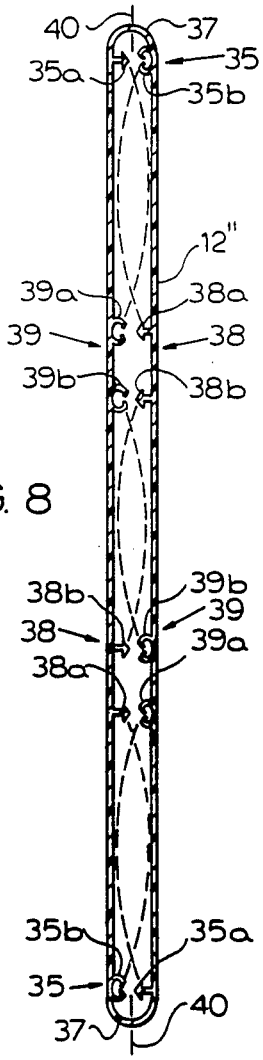

MATERIAL FOR MAKING THREE RECLOSABLE BAG SECTIONS FROM EXTRUDED PLASTIC MATERIAL

This invention relates to material for and method of making reclosable bags, and is more particularly concerned with new and improved bag making material for making three reclosable bag sections from extruded plastic material.

In the manufacture of bags of the type having opposed interlocking rib and groove elements on the confronting top edges of the bags, efforts are being continuously made to increase the speed of production output to thereby effect a saving in cost of the individual bags. There are factors which limit the speed of extrusion of the plastic film and the speed of joining of profiles.

Attempts to make multiple bags in a single extrusion operation encounter the problems of controlling the film and controlling the profiles. The profiles are joined before the film is wound in spools in order to avoid the risk of not knowing whether or not acceptable interlocking profiles have been provided, and in order to complete the continuous strip or section in a form which is suitable for storage without deforming the profiles or damaging the film adjacent to the profiles.

Methods have heretofore been employed wherein tubular film has been formed and folded in such a way as to simultaneously make dual bags with each cross-sealing operation.

Examples of prior art expedients are referred to by way of the following U.S. Patents:

Re. U.S. Pat. No. 29,331 which discloses a tube with multiple profiles on the surface for making two longitudinal folded bag sections.

U.S. Pat. No. 4,290,467 discloses a plastic film hang-up merchandise display bag and the method of making such a bag.

U.S. Pat. No. 3,945,403 provides for structures for forming fastener strips which are used by attaching them to the tops of separately formed bag material for providing separable closures for the bags.

U.S. Pat. No. 3,948,705 discloses how material, such as may be produced by the disclosure of U.S. Pat. No. 3,945,403, may be applied to plastic film web by fusion attachment.

U.S. Pat. No. 4,372,793 discloses how fastener strips, such as produced by U.S. Pat. No. 3,945,403, may be applied to the plastic film web or other bag making web by adhesive attachment.

None of the foregoing disclosures teaches how to produce more than just two bag making sections at a time from a single tubular fastener profile carrying plastic extrusion or any other form of the bag material.

The concept of the present invention is to produce simultaneously multiples of three reclosable bag sections from profile carrying plastic material. However, a difficulty is encountered in handling the large amount of plastic film so that the profiles are aligned and joined in such a manner that the multiples of three reclosable bag sections can be efficiently produced. This is especially the case where a tubular extrusion must be handled by collapsing the tube, properly slitting the tube and joining the profiles in a manner to provide reclosable fasteners along the edges of the folded bag making sections which will serve as the tops of the bags eventually made from the sections.

It is, accordingly, an object of the present invention to provide a new and improved bag making material and method which can be efficiently produced from fastener profile carrying web.

Another object of the invention is to provide such a web which can in a unique manner be folded and the profiles joined in multiples of three reclosable bag sections.

Still another object of the invention is to provide a new and improved bag making material which readily lends itself to attaining one or more multiples of three longitudinal bag sections from a single tubular extrusion.

Yet another object of the invention is to provide a new and improved material for making reclosable bag sections from integral extruded plastic web and profile tubing wherein at least one double bag section and one single bag section can be continuously produced.

Pursuant to the principles of the present invention, material for making three reclosable bag sections from separable fastener equipped web, comprises a bag making web having opposite free portions and an intervening portion, the intervening portion being folded upon itself and the free portions being folded inwardly upon themselves, whereby to provide three bag sections in a generally Y orientation; and separably interlockable fastener profiles adjacent to juncture of the three sections and arranged to provide a respective bag top separable profile fastener assembly along each of the sections.

Further, the present invention provides material for making three reclosable bag sections from extruded plastic tubing which comprises extruded plastic tubular web carrying a multiple of three sets of longitudinally extending pairs of adjacent complementary parallel rib and groove fastener profiles with a respective web panel between the profiles of each set, the three sets of fastener profiles being located in such spaced relation to one another that by separating the web panel between profiles of one of the sets and folding the web longitudinally into three longitudinal bag sections and interlocking the profiles of the one set of profiles with the nearest profiles to it of the other two sets of profiles and interlocking the remaining profiles of the other two sets with one another, there is provided a respective bag top separable fastener assembly on each folded bag section.

A method of making the three section bag making material is also provided.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 4 is an end view of a tubular plastic profile film having the profiles oriented for producing bag making sections of different widths;

FIG. 5 shows the tubing of FIG. 4 collapsed and ready to be separated and manipulated into three longitudinal bag making sections;

FIG. 6 shows the collapsed tubing of FIG. 5 separated and manipulated to provide the three differential width bag making sections;

FIG. 7 shows how the tubing as manipulated in FIG. 6 may be separated into a single bag making section and a dual bag making section; and FIG. 8 shows how multiples of the three bag making section expedient of FIGS. 1 to 3 may be attained.

Figure 1:
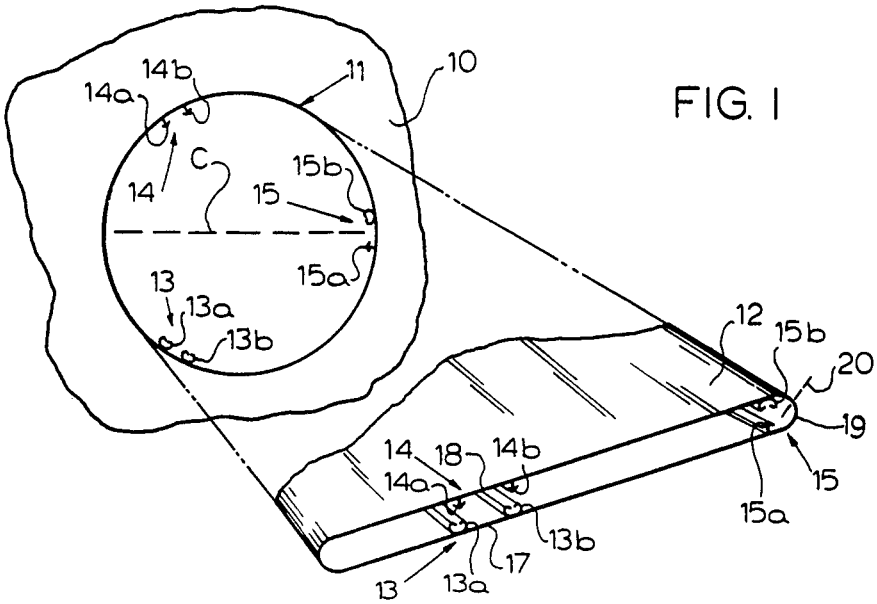
FIG. 1 is a schematic perspective view of a tubular plastic profile film being extruded and slit longi- tudinally.

In FIG. 1 is shown an extruder 10 of the type in which molten plastic such as polyethylene or other plastic suitable for the purpose may be extruded under pressure through an annular orifice 11 to form a continuous tubular film web 12. In this instance, the orifice 11 is constructed on its inner surface to extrude three sets of fastener profile orifices 13, 14 and 15 for producing corresponding sets of profiles 13, 14 and 15 of the complementary rib and groove type integral with the web 12 in proper orientation to be interlockable and separable so as to provide reclosable fasteners at the confronting top edge portions of three plastic film bags which are to be made from triple sections derived from the extrusion. Where the triple bag sections to be made from the fastener profile equipped film 12 are to be of equal width as exemplified in FIG. 2, the sets of profiles 13, 14 and 15 are located at 120° intervals about the inner circumference of the plastic tube web. Profiles 13*a* and 13*b* of the profile set 13 are of complementary interlockable shape relative to profiles 14*a* and 14*b* of the set of profiles 14. In this instance the profiles 13*a* and 13*b* are of generally groove-shape with which are separably interlockable the profiles 14*a* and 14*b* which are of generally arrow-shape. On the other hand, the set of profiles 15 comprise, respectively, a rib profile 15*a* at the side of this set which is nearest the groove-shape profile 13*b*. The companion profile 15*b*, which is of complementary groove shape, is located at the side of the profile set 15 which is nearest the profile 14*b*.

After formation of the profile carrying tubular web 12, it is collapsed upon itself along a diametric line C which extends midway between the sets of profiles 13 and 14, and midway between the profiles 14*a* and 15*b* of the profile set 15. In this collapsed state of the tubular web 12, the profiles 13*a* and 14*a* face each other and the profiles 13*b* and 14*b* face each, with a relatively narrow web panel 17 separating and intervening between the profiles 13*a* and 13*b* facing a corresponding web panel 18 of equal width intervening between and separating the profiles 14*a* and 14*b*. Also, a web panel 19 of similar width intervenes and separates the profiles 15*a* and 15*b* and in the collapsed condition of the tubular web assumes a folded condition as shown in FIG. 1.

Figure 2:
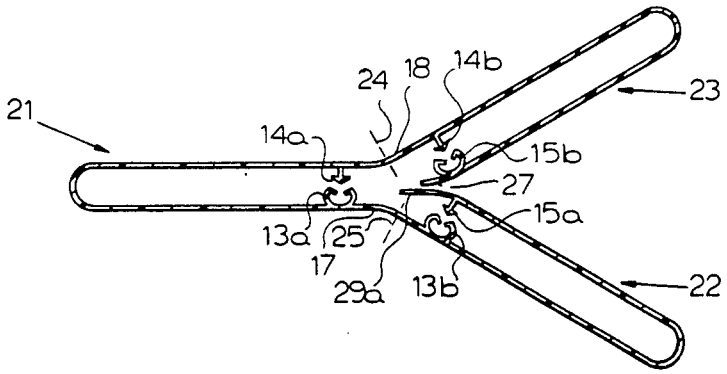
FIG. 2 is a schematic sectional view of the split tubing folded and manipulated to produce three bag making sections.

In order to form three reclosable bag sections from the described collapsed tubular web, the web panel 19 is separated, such as by slitting, longitudinally along a line 20. The two thus free portions of the web 12 at the opposite sides of the separation 20 are folded inwardly upon themselves as shown in FIG. 2 to bring the profile 15*a* into registration with the profile 13*b*, and the profile 15*b* into registration with the profile 14*b*. The profiles 13*a* and 14*a* of the intervening folded portion of the web 12 remain in registration with one another. As the folding occurs the registered profiles 13*a* and 14*a* as well as the profiles 13*b* and 15*a* and 14*b* and 15*b* may be interlockably forced together, but are shown as slightly separated for illustrative purposes. The folding now provides three reclosable bag sections 21, 22 and 23, and wherein the sections 22 and 23 diverge from their connection with the intermediate section 21 in a generally Y arrangement, and with the sets of profiles adjacent to the juncture of the three sections. Since the sections 22 and 23 are already separated from one another, either or both of them may be separated from the section 21. For example, the section 23 may be separated from the section 21 as by slitting longitudinally along a line 24 along the web panel 18. On the other hand, the sections 21 and 22 may be separated from one another by means of a longitudinal separation line 25 along the web panel 17.

Figure 3:
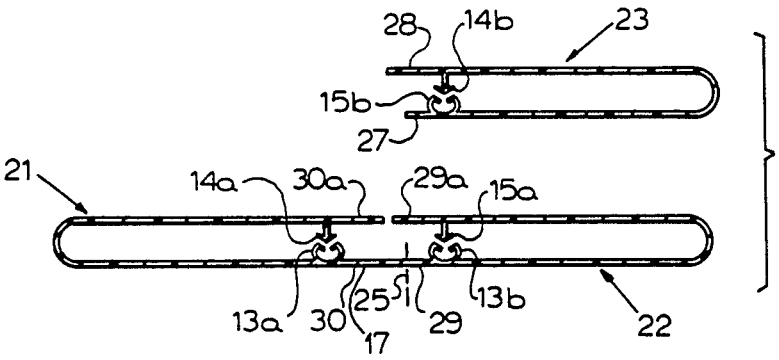
FIG. 3 is a schematic illustration showing the three bag making sections separated into a single bag making section and dual bag making sections.

If preferred, of course, separation of the sections 21, 22 and 23 may be effected as exemplified in FIG. 3 where the section 23 is separated from the sections 21 and 22, and the sections 21 and 22 are left joined by the web panel 17 until formed into bags by cross sealing in a dual bag machine, whereafter the sections 21 and 22, or the bags into which the sections are subdivided may by separated along the separation line 25. Separation line 20 may be laterally offset, as for example toward the profile 15*b*, so that if the section 23 is separated from the section 21 by the separation 24 medially between the profiles 14*a* and 14*b*, the bag section 23 will be provided with pull flanges 27 and 28 which are of preferred differential width adjacent to the reclosable zipper provided by the interlockable profiles 14*b* and 15*b*. Similarly, the separation 25 may divide the web panel 17 into differential width pull flanges 29 and 30 cooperative with opposing pull flanges 29*a* and 30*a* on the opposite wall panels of the respective sections 21 and 22.

While in FIGS. 1–3 the reclosable bag sections 21, 22 and 23 are shown as of substantially equal width, the invention permits bag sections of differential widths to be formed wherein at least one of the three bag sections may be wider than the other three bag sections, as exemplified in FIGS. 4–7. Therein, an extruded tubular web 12' has three integral internal longitudinally extending parallel sets of profiles 31, 32 and 33 and wherein the profile sets 31 and 33 are equally spaced from the intermediate profile set 32, with about 70° spacing of the median profile set 32 from the other two profile sets. In this instance the profile set 31 comprises adjacently spaced rib profiles 31*a* and 31*b*. The median profile set comprises adjacently spaced groove profiles 32*a* and 32*b*. On the other hand the profile set 33 comprises a rib profile 33*a* and a groove profile 33*b*.

Upon folding the tubular web 12' along a diametric line C' which runs medially between the profile sets 31 and 32, there is a resulting registration of the profiles 31*a* and 32*a* as well as of the profiles 31*b* and 32*b*. The profile set 33 may then lie on the same side of the folded tubular web 12' as the profile set 32. Upon separating the web along a line 20' midway between the profiles 33*a* and 33*b*, and folding the web at each side of the separation line 20' inwardly upon itself to bring the profile 33*a* into registration with the profile 32*b*, and to bring the profile 33*b* into registration with the profile 31*b*, three fold sections 21', 22' and 23' will be provided wherein the sections 21' and 22' are substantially equal width and the section 23' of greater width. Separation of the section 23' from the other sections may be effected along a separation line 24', and if desired the sections 21' and 22' may remain connected but eventually separable from one another along a separation line 25', similarly as described in connection with FIGS. 2 and 3.

It may be observed that various width permutations may be effected for the sections 21', 22' and 23' by appropriate placement of the three sets of profiles 31, 32 and 33. For example, instead of the section 23' being wider than the other two sections, the section 23' may be narrower, as indicated in dash outline, while the sections 21' and 22' may be wider.

Where practicable, as for example for smaller size bags, multiples of the three sets of cooperatively related profiles may be extruded on a single tubular web 12" as indicated in FIG. 8 where the web is shown as already collapsed. In this arrangement, the collapsing is effected diametrically between diametrically opposite sets of similar profiles 35 each of which comprises a rib profile 35*a* and a grooved profile 35*b* lying opposite one another at connecting folds provided by respective web panels 37. At each respective opposite side of the collapsed web 12" the profiles 35*a* and 35*b* are reversed relative to the other side, substantially as shown. Between the opposite side profile sets 35, each span of the folded web 12" has respective sets of rib profiles 38 and groove profiles 39, substantially as shown, such that when the two halves of the collapsed web 12" are severed from one another along longitudinal lines 40 through the web panels 37, the two halves may be folded upon themselves in substantially the manner in which the web 12 is folded to produce three equal bag section.

After the two halves of the web 12" have been separated along the lines 40, the two halves are folded upon themselves to register the respective profiles 35*a* with adjacent respective profiles 39*a*. The respective profiles 35*b* register with adjacent profiles 38*a*. Profiles 38*b* and 39*b* which are adjacent to one another on the same half of the web 12" are brought into registration with one another. This will result in a generally Y-shaped arrangement of bag section for each half of the web 12" similar to the generally Y arrangement of bag sections in FIG. 2. In other words, the arrangement in FIG. 8 will result in twice as many bag sections as the arrangement in FIG. 2. By relatively spacing the sets of profiles in each half of the web 12" in substantially the manner described for FIG. 5, bag sections of different widths may be attained.

It will be understood that variations and modifications may be effected without departing from the spirit and scope of the novel concepts of the present invention.

I claim as my invention:

1. Material for making 3 reclosable bag sections from separable fastener equipped web, comprising:

a bag making web having opposite free portions and an intervening portion;

said intervening portion being folded upon itself and said free portions being folded inwardly upon themselves, whereby to provide 3 bag sections extending from a juncture in a generally Y orientation and each section having a bag top adjacent to said juncture;

and a respective separable profile fastener assembly comprising separably interlockable fastener profiles on each of said bag tops adjacent to said juncture.

2. Material according to claim 1, wherein said bag sections are separable from one another at said juncture, and pull flanges along the separable fastener assembly of each of the sections.

3. Material according to claim 1, wherein said web carries thereon, before folding, three spaced sets of fastener profiles, and after the folding each profile of each set is registered in separable fastener assembly with a complementary profile of a different set.

4. Material according to claim 3, wherein said web comprises extruded plastic tubing wherein said sets of fastener profiles are integrally joined with the tubing, the tubing being separated between the profiles of one of said sets to provide said web and the separated profiles being matched with respective profiles of the other two sets and providing two of said fastener assemblies, and the remaining profiles of said other two sets being registered with one another to provide the third fastener assembly.

5. Material according to claim 1, wherein said bag sections are of different widths.

6. Material according to claim 1, wherein said web comprises an extruded plastic tube carrying a multiple of three sets of longitudinally extending complementary parallel fastener profiles, said tube being separated between certain of said profiles, and wherein said certain profiles have therebetween additional sets of profiles, so that the separated tube is foldable into said three Y oriented bag section units having said fastener assemblies.

7. Material for making a multiple of 3 adjoining reclosable bag sections from extruded plastic tubing, and comprising:

an extruded plastic tubular web carrying a multiple of 3 sets of longitudinally extending pairs of adjacently spaced complementary parallel fastener profiles with a respective web panel between the profiles of each set;

and sets of fastener profiles being located in such spaced relation to one another that by separating the web panel between the profiles of certain of said sets and folding said web longitudinally into multiples of 3 longitudinal bag sections and interlocking the profiles of said certain sets of profiles with the nearest profiles of other sets of profiles and interlocking the remaining profiles of said other sets with one another, there is provided a respective bag top separable fastener assembly along each of said bag sections.

8. Material according to claim 7, wherein said tubular web is separated between said certain profiles and the web is folded to provide said bag sections and the folded bag sections are oriented in a generally Y-shaped orientation.

9. Material according to claim 8, wherein the bag sections are of different widths.

10. Material according to claim 7, wherein said web panels provide material for pull flanges along said bag top fastener assemblies.

11. Material according to claim 10, wherein said web panels material provides for pull flanges of different widths for each of said fastener assemblies.

12. A method of making material for 3 reclosable bag sections from separable fastener equipped web, comprising:

providing bag making web having opposite free portions and an intervening portion;

folding the intervening portion upon itself;

folding said free portions inwardly upon themselves, whereby to provide with said intervening portion 3 bag sections extending from a juncture in a generally Y orientation and each section having a bag top adjacent to said juncture;

and providing a respective separable profile fastener assembly comprising separably interlocking fastener profiles on each of said bag tops adjacent to said juncture.

13. A method according to claim 12, comprising separating said bag sections from one another at juncture of said sections, and forming pull flanges along the separable fastener assembly of each of the sections.

14. A method according to claim 12, which comprises providing on the web before folding 3 sets of fastener profiles, and in the folding registering each profile of each set in separable fastener assembly with a complementary profile of a different set.

15. A method according to claim 14, comprising extruding plastic tubing to provide said web and integrally joining said sets of fastener profiles with the tubing, separating the tubing between the profiles of one of said sets and matching the separated profiles with respective profiles of the other 2 sets into a fastener assembly, and registering the remaining profiles of the other 2 sets with one another into a fastener assembly.

16. A method according to claim 12, which comprises forming said sections of different widths.

17. A method according to claim 12, which comprises extruding said web in the form of a plastic tube and providing said plastic tube with a multiple of 3 sets of longitudinally extending complementary parallel fastener profiles, separating the tube between certain of the profiles and leaving additional sets of profiles between separated profiles at opposite sides of the separated portions of the web, and folding the separated portions of the web and joining the fasteners of the separated portions into a plurality of Y-oriented bag section units.

* * * * *